US011408252B2

(12) United States Patent
Edwards et al.

(10) Patent No.: US 11,408,252 B2
(45) Date of Patent: Aug. 9, 2022

(54) SURFACE CONTROLLED SUBSURFACE SAFETY VALVE (SCSSV) SYSTEM

(71) Applicants: Jason Edwards, Broken Arrow, OK (US); John Burris, Bixby, OK (US)

(72) Inventors: Jason Edwards, Broken Arrow, OK (US); John Burris, Bixby, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 50 days.

(21) Appl. No.: 17/003,253

(22) Filed: Aug. 26, 2020

(65) Prior Publication Data

US 2022/0065074 A1 Mar. 3, 2022

(51) Int. Cl.

| | |
|---|---|
| ***E21B 34/16*** | (2006.01) |
| ***E21B 34/06*** | (2006.01) |
| ***E21B 34/14*** | (2006.01) |

(52) U.S. Cl.

CPC ..... *E21B 34/16* (2013.01); *E21B 34/066* (2013.01); *E21B 34/14* (2013.01)

(58) Field of Classification Search

CPC ..... E21B 34/16; E21B 34/066; E21B 34/14; E21B 34/12; E21B 34/106

See application file for complete search history.

(56) References Cited

U.S. PATENT DOCUMENTS

| | | | | |
|---|---|---|---|---|
| 4,376,464 | A * | 3/1983 | Crow | E21B 34/102 166/324 |
| 4,569,397 | A * | 2/1986 | Brakhage, Jr. | F16K 5/0647 166/321 |
| 4,660,646 | A * | 4/1987 | Blizzard | E21B 34/101 166/321 |
| 5,411,096 | A * | 5/1995 | Akkerman | E21B 34/10 166/321 |
| 8,002,042 | B2 * | 8/2011 | Going, III | E21B 34/066 166/373 |
| 2009/0236099 | A1 * | 9/2009 | Burris | E21B 34/101 166/321 |
| 2020/0032616 | A1 * | 1/2020 | Vick, Jr. | E21B 34/14 |
| 2020/0095843 | A1 * | 3/2020 | Vick, Jr. | F16K 5/08 |

* cited by examiner

*Primary Examiner* — Michael R Wills, III
(74) *Attorney, Agent, or Firm* — Cantor Colburn LLP

(57) ABSTRACT

A downhole tool including a valve portion having a valve housing including an inner chamber and an actuation tubular. The actuation tubular includes an outer surface, an inner surface defining a flow path, an upper end, and a lower end. A first spring extends about the outer surface of the actuation tubular between the upper end and the lower end. An actuator portion is detachably connected to the actuation tubular. The actuator portion includes an actuator housing, an actuator member arranged in the actuator housing, and a second spring operatively connected to the actuator member. The actuator member includes a first end portion operatively connected to the first spring and a second end portion. The actuator portion is selected and connected to the downhole tool to establish a selected actuation force through the second spring to compress the first spring causing the actuation tubular to shift within the inner chamber.

20 Claims, 3 Drawing Sheets

SURFACE CONTROLLED SUBSURFACE SAFETY VALVE (SCSSV) SYSTEM

BACKGROUND

In the drilling and completion industry, surface controlled subsurface safety valves (SCSSV) are employed as part of a completion to prevent formation or wellbore fluids from flowing, uncontrolled to the surface. Typically, the SCSSV includes a flapper that opens in a downhole direction. As such, an actuation event, such as hydraulic pressure from the surface may open the SCSSV. When the pressure from the surface is released, a power spring causes the SCSSV to close. In this manner, the SCSSV acts as a failsafe, e.g., fails closed if there is an issue at the surface.

The location, e.g., depth of the SCSSV in the completion may vary. The setting depth of the SCSSV determines which power spring and spring housing length is needed. Therefore, a user must keep a large inventory of SCSSV's on hand to accommodate various setting depths. The need to store and maintain multiple SCSSV's increases carrying costs. Therefore, the industry would welcome a system for activating a SCSSV that may readily accommodate multiple depth settings without the need to store and maintain multiple, different, valve configurations.

SUMMARY

Disclosed is a downhole tool including a valve portion having a valve housing including an inner chamber and an actuation tubular slidingly arranged in the inner chamber. The actuation tubular includes an outer surface, an inner surface defining a flow path, an upper end, and a lower end. A first spring extends about the outer surface of the actuation tubular between the upper end and the lower end. The first spring abuts the valve housing. An actuator portion is detachably connected to the actuation tubular. The actuator portion includes an actuator housing, an actuator member arranged in the actuator housing, and a second spring operatively connected to the actuator member. The actuator member includes a first end portion operatively connected to the first spring and a second end portion. The actuator portion is selected and connected to the downhole tool to establish a selected actuation force through the second spring to compress the first spring causing the actuation tubular to shift within the inner chamber.

Also disclosed is a resource exploration and recovery system including a first system and a second system including one or more tubulars fluidically connected to the first system. The one or more tubular defining, at least in part, a completion having a downhole tool including a valve portion having a valve housing including an inner chamber and an actuation tubular slidingly arranged in the inner chamber. The actuation tubular includes an outer surface, an inner surface defining a flow path, an upper end, and a lower end. A first spring extends about the outer surface of the actuation tubular between the upper end and the lower end. The first spring abuts the valve housing. An actuator portion is detachably connected to the actuation tubular. The actuator portion includes an actuator housing, an actuator member arranged in the actuator housing, and a second spring operatively connected to the actuator member. The actuator member includes a first end portion operatively connected to the first spring and a second end portion. The actuator portion is selected and connected to the downhole tool to establish a selected actuation force through the second spring to compress the first spring causing the actuation tubular to shift within the inner chamber.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
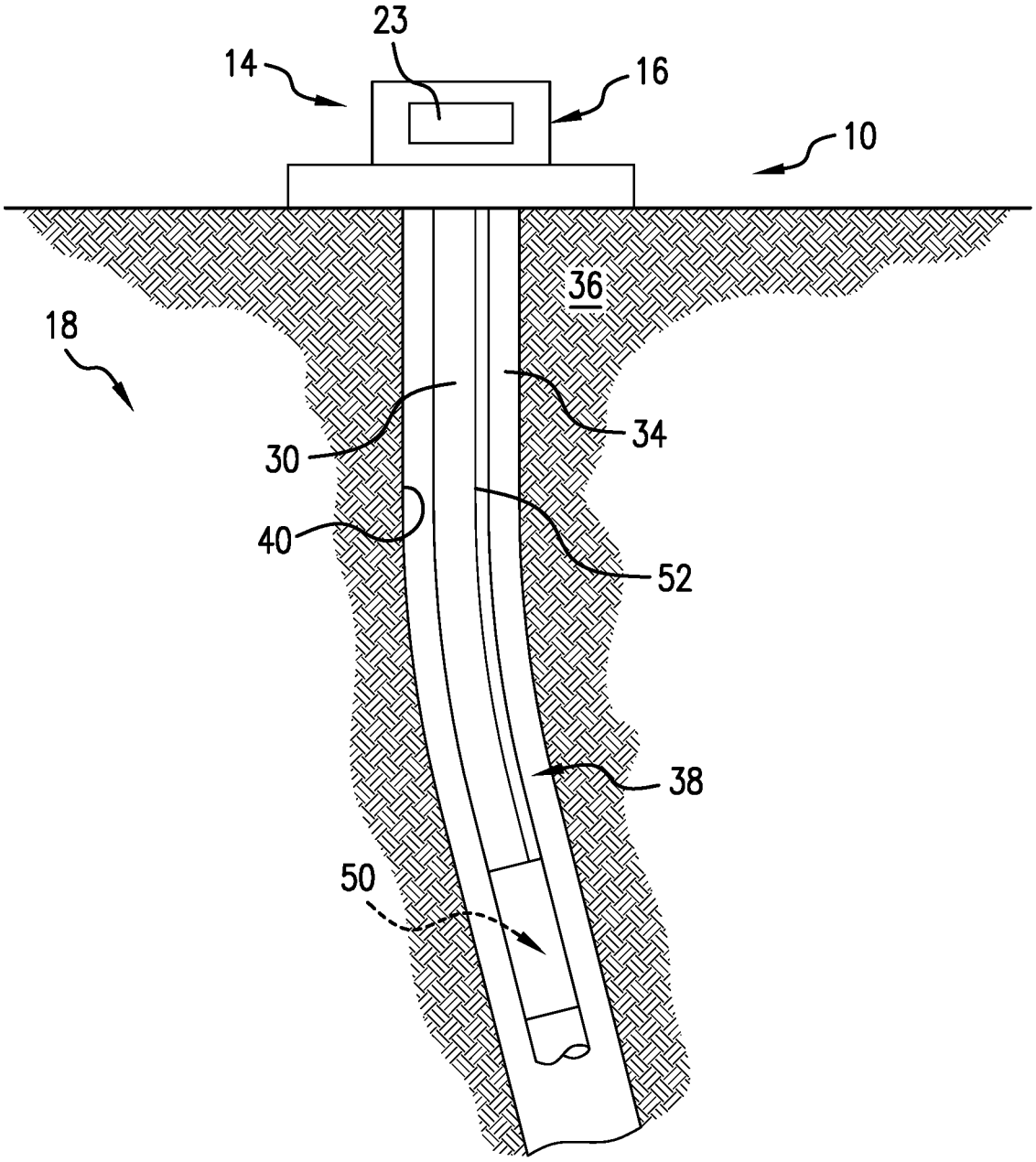
FIG. 1 depicts a resource exploration and recovery system including a surface controlled subsurface safety valve (SCSSV), in accordance with an exemplary embodiment.
Figure 2:
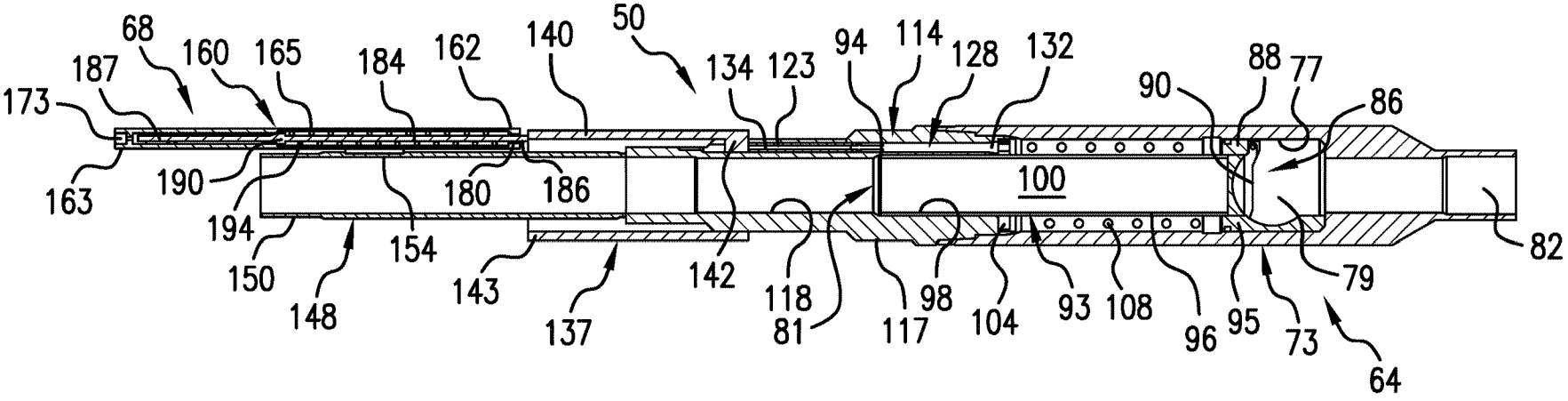
FIG. 2 depicts a SCSSV arranged in a closed configuration, in accordance with an aspect of an exemplary embodiment.

A resource exploration and recovery system, in accordance with an exemplary embodiment, is indicated generally at 10, in FIGS. 1 and 2. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface or downhole system (not separately labeled).

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Tubular string 30 may take the form of a completion 38 and could be formed from a plurality of interconnected tubulars (not separately labeled). Wellbore 34 includes an annular wall 40 which may be defined by a surface of formation 36. Of course, it should be understood, that wellbore 34 may include a casing tubular (not shown).

Figure 3:
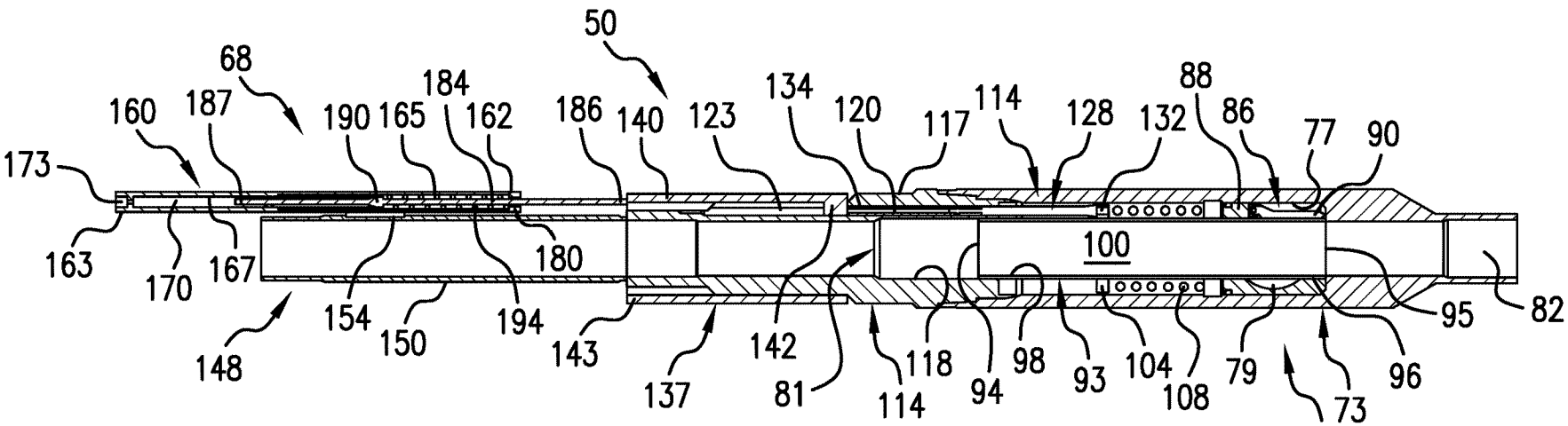
FIG. 3 depicts the SCSSV of FIG. 2 in an open configuration, in accordance with an aspect of an exemplary embodiment.

In an embodiment, tubular string 30 includes a downhole tool shown as a surface controlled subsurface safety valve (SCSSV) 50 that is operatively connected to first system 14 through a control line 52. In an embodiment, fluid pressure, such as hydraulic pressure, controlled by control system 23 may be introduced into control line 52. As shown in FIGS. 2-3, SCSSV 50 includes a valve portion 64, and an actuator portion 68. As will be detailed more fully herein, actuator portion 68 is configured for a specific setting depth, or range of setting depths for SCSSV 50. Further, actuator portion 68 may take the form of an interchangeable module that may be selectively connected with valve portion 64 and configured for a specific setting depth, or range of setting depths for SCSSV 50.

In an embodiment, valve portion 64 includes a valve housing 73 having an inner surface 77 that defines an inner chamber or valve chamber 79. Valve housing 73 includes an inlet 81 and an outlet 82. A valve 86 is arranged in inner chamber 79. Valve 86 includes a stationary portion 88 that is fixedly mounted to valve housing 73 and a moveable portion or flapper 90 that is pivotally mounted to stationary portion 88. An actuation tubular 93 is arranged in valve housing 73 and may be shifted to open flapper 90. Actuation tubular 93 includes a first or upper end 94, a second or lower end 95, an outer surface 96, and an inner surface 98 that defines a flow path 100 that is selectively fluidically connected to outlet 82.

A first piston collar 104 is fixedly mounted to outer surface 96. A first power spring 108 extends about outer surface 96 of actuation tubular 93 between first piston collar 104 and stationary portion 88 of valve 86. A first piston housing 114 is mounted to actuation tubular 93. First piston housing 114 includes an outer surface section 117 and an inner surface section 118 that defines a first piston receiver 120 (FIG. 3). Outer surface section 117 may also include a radially outwardly projecting guide element 123.

In an embodiment, a first piston 128 is arranged in first piston receiver 120. First piston 128 includes a first end 132 and a second end 134. First end 132 is connected to first piston collar 104. Second end 134 is connected to an actuator 137. Actuator 137 may take the form of a slip ring 140 mounted about piston housing 114. Slip ring 140 includes a first end section 142 coupled to second end 134 of first piston 128 and a second end section 143. Slip ring 140 moves over piston housing 114 causing first piston 128 to shift first piston collar 104 against first power spring 108. Thus, slip ring 140 causes actuation tubular 93 to shift through valve 86 opening flapper 90. Slip ring 140 may be constrained for rotation relative to first piston housing 114 by guide element 123. A tubular 148 is coupled to second end section 143 of actuator 137. Tubular 148 includes an outer surface 150.

In accordance with an exemplary aspect, actuator portion 68 includes an actuator housing 160 having a first end portion 162, a second end portion 163, an outer surface portion 165, and an inner surface portion 167 that defines an interior portion (not separately labeled). Outer surface portion 162 of actuator housing 160 is detachably connected to outer surface 150 of tubular 148. For example, actuator housing 160 may be bolted to tubular 148 through a connector 154. Inner surface portion 167 of actuator housing 160 defines a second piston receiver 170 (FIG. 3). In an embodiment, control line 52 may connect with a control line connector 173 provided at second end portion 163. First end portion 162 of actuator housing 160 included a radially inwardly projecting spring stop 180.

An actuator member shown as a second piston 184 is arranged in second piston receiver 170. Second piston 184 includes a first end portion 186 and a second end portion 187. Second piston 184 also includes a radially outwardly extending projection 190 arranged between first end portion 186 and second end portion 187. A second power spring 194 is arranged about second piston 184 between radially outwardly extending projection 190 and radially inwardly projecting spring end stop 180 in actuator housing 160. Control line 52 may deliver pressurized fluid to actuator housing 160 through control line connector 173. The pressurized fluid acts upon second piston 184 thereby loading second power spring 194. In addition to loading second power spring 194, second piston 184 also acts upon slip ring 140 thereby driving first piston 128 to shift first piston collar 154 forcing actuation tubular 93 through flapper 90.

With this arrangement, valve portion 64 may be a standard component that is placeable anywhere along completion 32. Actuator portion 68 may be specifically tailored to a desired depth. That is, actuator portion 64 may be provided with a specific spring having a selected spring constant/spring length associated with the desired depth or a depth range that includes the desired depth that that s connectable with valve portion 64. Thus, the SCSSV may be readily reconfigurable simply by adding a selected actuator portion 68 having a selected spring to valve portion 64.

Figure 4:
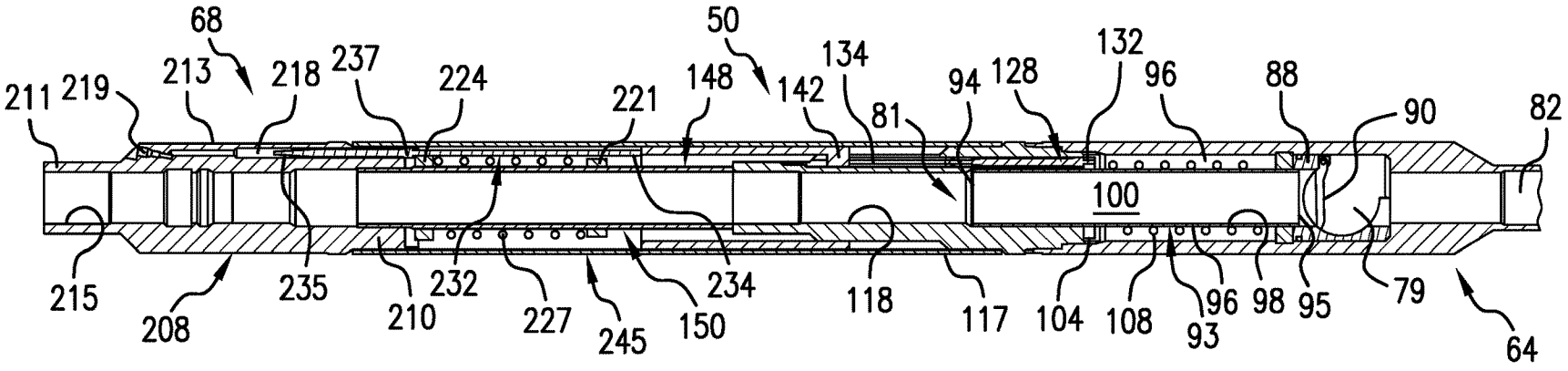
FIG. 4 depicts a SCSSV arranged in a closed configuration, in accordance with another aspect of an exemplary embodiment.
Figure 5:
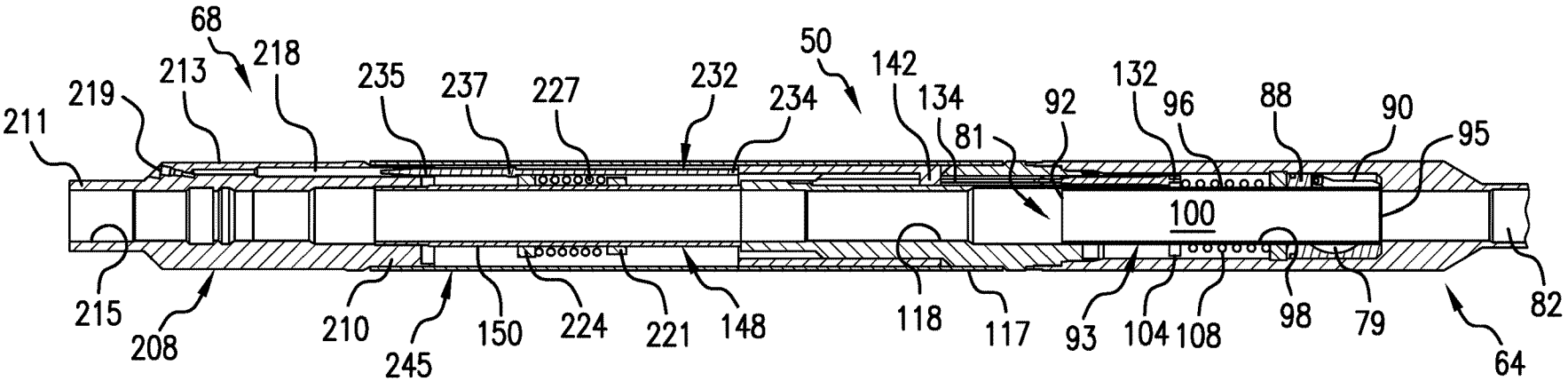
FIG. 5 depicts the SCSSV of FIG. 4 in an open configuration, in accordance with an aspect of an exemplary embodiment.

Reference will now follow to FIGS. 4 and 5, wherein like reference numbers represent corresponding parts in the respective views, in describing an actuator housing 208 in accordance with another aspect of an exemplary embodiment for SCSSV 50. Actuator housing 208 includes a first end portion 210, a second end portion 211, an outer surface portion 213 and an inner surface portion 215 that defines an interior portion (not separately labeled.). A second piston receiver 218 is arranged between outer surface portion 213 and inner surface portion 215. Second piston receiver 218 includes a control line connector 219 that may interface with control line 52.

In an embodiment, tubular 148 includes a radially outwardly directed projecting portion 221 extending from, and fixedly mounted to, outer surface 150. A second piston collar 224 is slideably mounted to outer surface 150 of tubular 148. A second power spring 227 is arranged between second piston collar 224 and radially outwardly directed projecting portion 221. A second piston 232 is arranged in second piston receiver 218. Second piston 232 includes a first end portion 234 and a second end portion 235. An outwardly extending projection 237 is arranged on piston 232 between first end portion 234 and second end portion 235. A protective cover 245 may extend about tubular 148 to shield second power spring 228, second piston 232 and other components of actuator portion 68 from downhole fluids and or debris.

In a manner similar to that discussed above, a fluid pressure may be applied to actuator housing 208 through control line 52. The fluid pressure acts upon second piston 232 which shifts second piston collar 224 along outer surface 150 thereby loading second power spring 227. Second piston 232 also acts upon slip ring 140 thereby driving first piston 128 to shift first piston collar 154 forcing actuation tubular 93 through flapper 90. In a manner also similar to that described above, the exemplary embodiments enable valve portion 64 to be a standard component that is placeable anywhere along completion 32 at any depth. Actuator portion 68 may be specifically tailored to a desired depth. That is, actuator portion 64 may be provided with a specific spring having a selected spring constant/spring length associated with the desired depth or a depth range that includes the desired depth. Thus, the SCSSV may be readily reconfigurable simply by adding a spring to the actuator portion, or a selected actuator portion to the valve portion.

Set forth below are some embodiments of the foregoing disclosure:

Embodiment 1. A downhole tool comprising: a valve portion including a valve housing having an inner chamber; an actuation tubular slidingly arranged in the inner chamber, the actuation tubular including an outer surface, an inner surface defining a flow path, an upper end, and a lower end; a first spring extending about the outer surface of the actuation tubular between the upper end and the lower end, the first spring abutting the valve housing; and an actuator portion detachably connected to the actuation tubular, the actuator portion including an actuator housing and an actuator member arranged in the actuator housing, and a second spring operatively connected to the actuator member, the actuator member including a first end portion operatively connected to the first spring and a second end portion, the actuator portion being selected and connected to the downhole tool to establish a selected actuation force through the second spring to compress the first spring causing the actuation tubular to shift within the inner chamber.

Embodiment 2. The downhole tool according to any prior embodiment, wherein the actuator housing includes a first end supporting a control line connector and a second end including a spring end stop and an interior portion, the second spring being arranged in the interior portion.

Embodiment 3. The downhole tool according to claim 1, further comprising: a first piston housing connected to the actuation tubular, the first piston housing including a first piston and the first spring.

Embodiment 4. The downhole tool according to any prior embodiment, wherein actuator member defines a second piston including an outwardly extending projection arranged between the first end portion and the second end portion.

Embodiment 5. The downhole tool according to any prior embodiment, wherein the second spring extends about the second piston between the outwardly extending projection and the spring end stop.

Embodiment 6. The downhole tool according to any prior embodiment, further comprising a tubular connected to the first piston housing.

Embodiment 7. The downhole tool according to any prior embodiment, further comprising: an actuator arranged between the actuator portion and the valve portion, wherein the actuator comprises a slip ring extending about the tubular.

Embodiment 8. The downhole tool according to any prior embodiment, wherein the actuator housing is mounted to the tubular.

Embodiment 9. The downhole tool according to any prior embodiment, further comprising: a protective housing extending between the actuator housing and the second piston housing about the tubular and the actuator.

Embodiment 10. The downhole tool according to any prior embodiment, further comprising: a collar extending about and slidingly connected to the tubular, the second piston being operatively connected to the collar, wherein the tubular includes a radially outwardly directed projecting portion, the second spring being arranged between the collar and the radially outwardly directed projecting portion.

Embodiment 11. A resource exploration and recovery system comprising: a first system; a second system including one or more tubulars fluidically connected to the first system, the one or more tubular defining, at least in part, a completion having a surface controlled subsurface safety valve (SCSSV) comprising: a valve portion including a valve housing having an inner chamber; an actuation tubular slidingly arranged in the inner chamber, the actuation tubular including an outer surface, an inner surface defining a flow path, an upper end, and a lower end; a first spring extending about the outer surface of the actuation tubular between the upper end and the lower end, the first spring abutting the valve housing; and an actuator portion detachably connected to the actuation tubular, the actuator portion including an actuator housing and an actuator member arranged in the actuator housing, and a second spring operatively connected to the actuator member, the actuator member including a first end portion operatively connected to the first spring and a second end portion, the actuator portion being selected and connected to the downhole tool to establish a selected actuation force through the second spring to compress the first spring causing the actuation tubular to shift within the inner chamber.

Embodiment 12. The resource exploration and recovery system according to any prior embodiment, wherein the actuator housing includes a first end supporting a control line connector and a second end including a spring end stop and an interior portion, the second spring being arranged in the interior portion.

Embodiment 13. The downhole tool according to any prior embodiment, further comprising: a first piston housing connected to the actuation tubular, the first piston housing including a first piston and the first spring.

Embodiment 14. The downhole tool according to any prior embodiment, wherein actuator member defines a second piston including an outwardly extending projection arranged between the first end portion and the second end portion.

Embodiment 15. The resource exploration and recovery system according to any prior embodiment, wherein the second spring extends about the second piston between the outwardly extending projection and the spring end stop.

Embodiment 16. The resource exploration and recovery system according to any prior embodiment, further comprising a tubular connected to the first piston housing.

Embodiment 17. The resource exploration and recovery system according to any prior embodiment, further comprising: an actuator arranged between the actuator portion and the valve portion, wherein the actuator comprises a slip ring extending about the tubular.

Embodiment 18. The resource exploration and recovery system according to any prior embodiment, wherein the actuator housing is mounted to the tubular.

Embodiment 19. The resource exploration and recovery system according to any prior embodiment, further comprising: a protective housing extending between the actuator housing and the second piston housing about the tubular and the actuator.

Embodiment 20. The resource exploration and recovery system according to any prior embodiment, further comprising: a collar extending about and slidingly connected to the tubular, the second piston being operatively connected to the collar, wherein the tubular includes a radially outwardly directed projecting portion, the second spring being arranged between the collar and the radially outwardly directed projecting portion.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a valve portion including a valve housing having an inner chamber;

an actuation tubular slidingly arranged in the inner chamber, the actuation tubular including an outer surface, an inner surface defining a flow path, an upper end, and a lower end;

a first spring extending about the outer surface of the actuation tubular between the upper end and the lower end, the first spring abutting the valve housing; and an actuator portion detachably connected to the actuation tubular, the actuator portion including an actuator housing and an actuator member arranged in the actuator housing, and a second spring operatively connected to the actuator member, the actuator member including a first end portion operatively connected to the first spring and a second end portion, the actuator portion being selected and connected to the downhole tool to establish a selected actuation force through the second spring to compress the first spring causing the actuation tubular to shift within the inner chamber.

2. The downhole tool according to claim 1, wherein the actuator housing includes a first end supporting a control line connector and a second end including a spring end stop and an interior portion, the second spring being arranged in the interior portion.

3. The downhole tool according to claim 1, further comprising: a first piston housing connected to the actuation tubular, the first piston housing including a first piston and the first spring.

4. The downhole tool according to claim 3, wherein actuator member defines a second piston including an outwardly extending projection arranged between the first end portion and the second end portion.

5. The downhole tool according to claim 4, wherein the second spring extends about the second piston between the outwardly extending projection and the spring end stop.

6. The downhole tool according to claim 3, further comprising a tubular connected to the first piston housing.

7. The downhole tool according to claim 6, further comprising: an actuator arranged between the actuator portion and the valve portion, wherein the actuator comprises a slip ring extending about the tubular.

8. The downhole tool according to claim 6, wherein the actuator housing is mounted to the tubular.

9. The downhole tool according to claim 8, further comprising: a protective housing extending between the actuator housing and the second piston housing about the tubular and the actuator.

10. The downhole tool according to claim 8, further comprising: a collar extending about and slidingly connected to the tubular, the second piston being operatively connected to the collar, wherein the tubular includes a radially outwardly directed projecting portion, the second spring being arranged between the collar and the radially outwardly directed projecting portion.

11. A resource exploration and recovery system comprising:

a first system;

a second system including one or more tubulars fluidically connected to the first system, the one or more tubular defining, at least in part, a completion having a surface controlled subsurface safety valve (SCSSV) comprising:

a valve portion including a valve housing having an inner chamber;

an actuation tubular slidingly arranged in the inner chamber, the actuation tubular including an outer surface, an inner surface defining a flow path, an upper end, and a lower end;

a first spring extending about the outer surface of the actuation tubular between the upper end and the lower end, the first spring abutting the valve housing; and an actuator portion detachably connected to the actuation tubular, the actuator portion including an actuator housing and an actuator member arranged in the actuator housing, and a second spring operatively connected to the actuator member, the actuator member including a first end portion operatively connected to the first spring and a second end portion, the actuator portion being selected and connected to the downhole tool to establish a selected actuation force through the second spring to compress the first spring causing the actuation tubular to shift within the inner chamber.

12. The resource exploration and recovery system according to claim 11, wherein the actuator housing includes a first end supporting a control line connector and a second end including a spring end stop and an interior portion, the second spring being arranged in the interior portion.

13. The downhole tool according to claim 12, further comprising: a first piston housing connected to the actuation tubular, the first piston housing including a first piston and the first spring.

14. The downhole tool according to claim 13, wherein actuator member defines a second piston including an outwardly extending projection arranged between the first end portion and the second end portion.

15. The resource exploration and recovery system according to claim 14, wherein the second spring extends about the second piston between the outwardly extending projection and the spring end stop.

16. The resource exploration and recovery system according to claim 13, further comprising a tubular connected to the first piston housing.

17. The resource exploration and recovery system according to claim 16, further comprising: an actuator arranged between the actuator portion and the valve portion, wherein the actuator comprises a slip ring extending about the tubular.

18. The resource exploration and recovery system according to claim 17, wherein the actuator housing is mounted to the tubular.

19. The resource exploration and recovery system according to claim 18, further comprising: a protective housing extending between the actuator housing and the second piston housing about the tubular and the actuator.

20. The resource exploration and recovery system according to claim 19, further comprising: a collar extending about and slidingly connected to the tubular, the second piston being operatively connected to the collar, wherein the tubular includes a radially outwardly directed projecting portion, the second spring being arranged between the collar and the radially outwardly directed projecting portion.

* * * * *